US011442488B2

(12) United States Patent
Bruees

(10) Patent No.: US 11,442,488 B2
(45) Date of Patent: Sep. 13, 2022

(54) CONNECTION ELEMENT FOR A VEHICLE PEDAL AND VEHICLE PEDAL

(71) Applicant: Hella GmbH & Co. KGaA, Lippstadt (DE)

(72) Inventor: Heinrich-Reinhold (Heinz) Bruees, Geseke (DE)

(73) Assignee: Hella GmbH & Co. KGaA, Lippstadt (DE)

( * ) Notice: Subject to any disclaimer, the term of this patent is extended or adjusted under 35 U.S.C. 154(b) by 0 days.

(21) Appl. No.: 17/310,515

(22) PCT Filed: Feb. 4, 2020

(86) PCT No.: PCT/EP2020/052730
§ 371 (c)(1),
(2) Date: Aug. 6, 2021

(87) PCT Pub. No.: WO2020/169336
PCT Pub. Date: Aug. 27, 2020

(65) Prior Publication Data

US 2022/0147094 A1 May 12, 2022

(30) Foreign Application Priority Data

Feb. 21, 2019 (DE) ..... 10 2019 104 404.9

(51) Int. Cl.
*G05G 1/30* (2008.04)
*G05G 1/46* (2008.04)

(52) U.S. Cl.
CPC ..... *G05G 1/46* (2013.01)

(58) Field of Classification Search
CPC ..... G05G 1/30; G05G 1/44; G05G 1/445; G05G 1/46; B60T 7/04; B60T 7/06; F16B 2/20; F16B 2/22; F16B 2/243; F16B 5/06
See application file for complete search history.

(56) References Cited

U.S. PATENT DOCUMENTS

2015/0069197 A1* 3/2015 Mitchell ..... F16B 2/22 248/221.11
2015/0159731 A1* 6/2015 Thompson ..... A01K 61/55 24/305

(Continued)

FOREIGN PATENT DOCUMENTS

CN 201511825 U 6/2010
DE 102004059320 A1 6/2005

(Continued)

OTHER PUBLICATIONS

Machine Translation of EP 2388492.*

(Continued)

*Primary Examiner* — Richard W Ridley
*Assistant Examiner* — Brian J McGovern
(74) *Attorney, Agent, or Firm* — Husch Blackwell LLP

(57) ABSTRACT

A connection element is provided for connecting a first part with a second part of a vehicle pedal. An essentially rigid central section is provided, in addition to a first connecting section connecting the connection element to the first part and a second connecting section connecting the connection element with the second part. The two connecting sections are formed at free ends of the central section opposite each other. The first connecting section features at least two first latching elements that form a latching connection together with latching elements of the first part formed corresponding to the first latching elements. The first connecting section features four first latching elements. The first latching elements form, in the assembled state of the connection element, as pairs in each case a latching connection together with a latching element of the first part corresponding to each pair of latching elements.

11 Claims, 5 Drawing Sheets

(56) References Cited

U.S. PATENT DOCUMENTS

| | | | | |
|---|---|---|---|---|
| 2016/0310774 | A1* | 10/2016 | Publicover | A63B 5/11 |
| 2017/0219126 | A1* | 8/2017 | Kato | B60R 16/08 |
| 2019/0308818 | A1* | 10/2019 | McIntire | B65G 47/268 |

FOREIGN PATENT DOCUMENTS

| | | | | |
|---|---|---|---|---|
| DE | 102005059975 | A1 * | 6/2007 | B60K 26/021 |
| DE | 102006039526 | A1 | 3/2008 | |
| DE | 102008018140 | A1 * | 10/2009 | B60K 26/02 |
| EP | 2229613 | A1 | 9/2010 | |
| EP | 2388492 | A1 * | 11/2011 | F03D 9/002 |
| EP | 3072734 | A1 * | 9/2016 | A47C 31/023 |
| FR | 2900206 | A1 * | 10/2007 | B01D 53/002 |
| FR | 3065501 | A1 | 10/2018 | |

OTHER PUBLICATIONS

Machine Translation of DE 102005059975.*
Machine Translation of DE 102008018140.*
Machine Translation of FR 2900206.*
Machine Translation of EP 3072734.*

* cited by examiner

CONNECTION ELEMENT FOR A VEHICLE PEDAL AND VEHICLE PEDAL

CROSS REFERENCE

This application claims priority to PCT Application No. PCT/EP2020/052730, filed Feb. 4, 2020, which itself claims priority to German Application No. 10 2019 104404.9, filed Feb. 21, 2019, the entirety of both of which are hereby incorporated by reference.

FIELD OF THE INVENTION

The present invention relates to a connection element for connecting one first part with a second part of a vehicle pedal.

BACKGROUND

Such connection elements for vehicle pedals and vehicle pedals are already known from numerous embodiment variants of the state of the art.

The known connection elements for connecting a first part with a second part of a vehicle pedal comprise, for example, an essentially rigid central section, a first connecting section for connecting the connection element with the first part and a second connecting section for connecting the connection element with the second part, where the two connecting sections are formed at free ends of the central section opposite each other and where the first connecting section features at least two first latching elements that, when the connection element is in an assembled state, form, together with latching elements of the first part formed corresponding to the first connection elements, a latching connection.

SUMMARY OF THE INVENTION

This is where the present invention comes in.

The present invention is based on the task of improving the connection of a first part with a second part of the vehicle pedal.

This task is solved by means of a connection element characterized in that the first connecting section features four first latching elements, where, when the connection element is in an assembled state, the first latching elements as pairs in each case form a latching connection together with a latching element of the first part corresponding to each pair of first latching elements.

One significant advantage of the invention is specifically that the connection between a first part and a second part of the vehicle pedal is improved. For example, the invention can be used to ensure proper functioning of the inventive connection element and thus of the inventive vehicle pedal, even with difficult ambient conditions. This applies especially to inventive connection elements manufactured from plastic and for inventive vehicle pedals equipped with the same.

For example, high ambient temperatures can lead to plastics or similar materials softening. When approaching the temperature at which plastic and similar materials soften, the strength of the latching connection can start decreasing. This is where the invention provides a remedy. The invention can be used to maintain the durability of the latching connection formed between the connection element and the first part of the vehicle pedal when the inventive connection element is in an assembled state even at ambient temperatures in the temperature range at which the plastic or similar material starts to soften. Correspondingly, the proper functioning of the vehicle pedal is ensured even with adverse ambient conditions, such as an increased ambient temperature. This applies, for example, to connection elements manufactured from polypropylene (PP). With other embodiments, such as when polyoxymethylene (POM) is used for the connection element, the aforementioned issue of temperature is generally not incurred. PP, for example, is cheaper than POM, however. It is generally true of all plastics that their strength values decrease with increasing ambient temperature.

In general, the invention can be used to ensure a strong and thus reliable latching connection between the connection element on the one hand and the first part on the other. The invention provides a major advantage especially in the event of an uneven load on this latching connection by, for example, unwanted lateral forces placing stress on this latching connection. The load distribution in the inventive connection element and thus in the latching connection it forms with the first part is significantly improved in comparison to technical solutions known from the state of the art.

In principle, the inventive connection element can be selected at will within wide suitable limits in terms of type, functioning, material, dimensions and arrangement. This applies in particular to the inventive first latching elements. One advantageous refinement of the inventive connection element specifies that the first latching elements are formed by each pair of first latching elements at different latching arms of the first connecting section opposite each other. Firstly, this facilitates a customized design of the individual first latching elements of a pair of first latching elements and the latching arms corresponding to the same, which provides a great deal of design freedom. Secondly, the arrangement opposite each other of the first latching elements of a pair of first latching elements gives rise to a latching connection between the inventive connection element pursuant to this refinement on the one hand and the first part on the other that is very stable even under difficult ambient conditions such as a high ambient temperature.

One advantageous refinement of the inventive connection element in accordance with the aforementioned embodiment specifies that the latching arms of the first connecting section are arranged essentially parallel to each other when the connection element is in a disassembled state. This makes it possible to implement the first latching elements of a pair of first latching elements as latching elements located opposite each other, using simple a design and manufacturing methods. Furthermore, this facilitates, for example, a flat design of the inventive connection element. Preferentially, at least two of the latching arms are designed in such a way that these latching arms, in the assembled state of the connection element, are pretensioned with a previously specified force against the first part. Unwanted noise emission from the latching connection between the connection element and the first part when the connection element is in an assembled state is prevented, or at least reduced, by the pretensioning, for example. To the extent that the connection element is manufactured as a plastic part, it is possible to exploit the processing shrinkage of the plastic during manufacture for this purpose.

One advantageous refinement of the last-mentioned embodiment of the inventive connection element specifies that each pair of first latching elements features an exterior first latching element and an interior first latching element, where the latching arms of the two interior first latching elements of the two pairs are connected to each other to transmit force. This makes it possible to increase, with a simple design, the rigidity of the connection element and thus the strength of the latching connection formed by the connection element and the first part.

As already explained above, the first latching elements can be selected at will within wide suitable limits. One advantageous refinement of the inventive connection element specifies that the first latching elements are each designed in the form of a barb. This makes it possible firstly to more easily convert the connection element from its disassembled state to its assembled state. Secondly, the first latching elements being designed in the form of a barb ensures a functionally secure latching connection between the first latching elements of the inventive connection element on the one hand and the latching elements of the first part corresponding to the same.

One further advantageous refinement of the inventive connection element specifies that the central section features a base plate from which the latching arms of the first connection element extend. This implements, with a simple design, the essentially rigid central section. Furthermore, this facilitates a flat design of the inventive connection element.

One especially advantageous refinement of the aforementioned embodiment specifies that the force-transferring connection of the base plate with the individual latching arms is designed depending on a previously specified latching property of the latching connection. This increases the flexibility in the design and usability of the inventive connection element. Depending on the requirements of an individual case, this makes it possible to design the inventive connection element with the latching arms and the first latching elements formed on the same in such a way as to be more or less rigid. This is achieved, for example, through the respective free length of the individual latching arm being selected according to the desired rigidity of this individual latching arm. The free length of the respective latching arm designates the length of the latching arm on which the latching arm is not connected with the base plate in a manner to transmit force.

Another advantageous refinement of the inventive connection element specifies that the connection element is designed as a single-piece plastic part. Firstly, plastic is suitable for a large number of application cases and can be processed cheaply with a great degree of freedom of design. Secondly, forming the inventive connection element as a single-piece part of the reduces the number of components and thus also the manufacturing costs.

One advantageous refinement of the last-mentioned embodiment of the inventive connection element specifies that the first latching elements are designed to be hollow. This significantly simplifies the manufacture of the inventive connection element as a plastic part, as no unwanted material accumulation occurs in the area of the first latching elements during a plastic injection molding process, for example.

One especially advantageous refinement of the inventive vehicle pedal specifies that the connection element connects the first part and the second part to each other in an articulated manner. This improves the freedom of movement of the first part relative to the second part such that, for example, also more complex movement sequences with a movement of the first part relative to the second part of the vehicle pedal by means of the inventive connection element according to the present refinement are facilitated.

BRIEF DESCRIPTION OF THE DRAWINGS

Reference is now made more particularly to the drawings, which illustrate the best presently known mode of carrying out the invention and wherein similar reference characters indicate the same parts throughout the views.

DETAILED DESCRIPTION OF THE DRAWINGS

Figure 1:
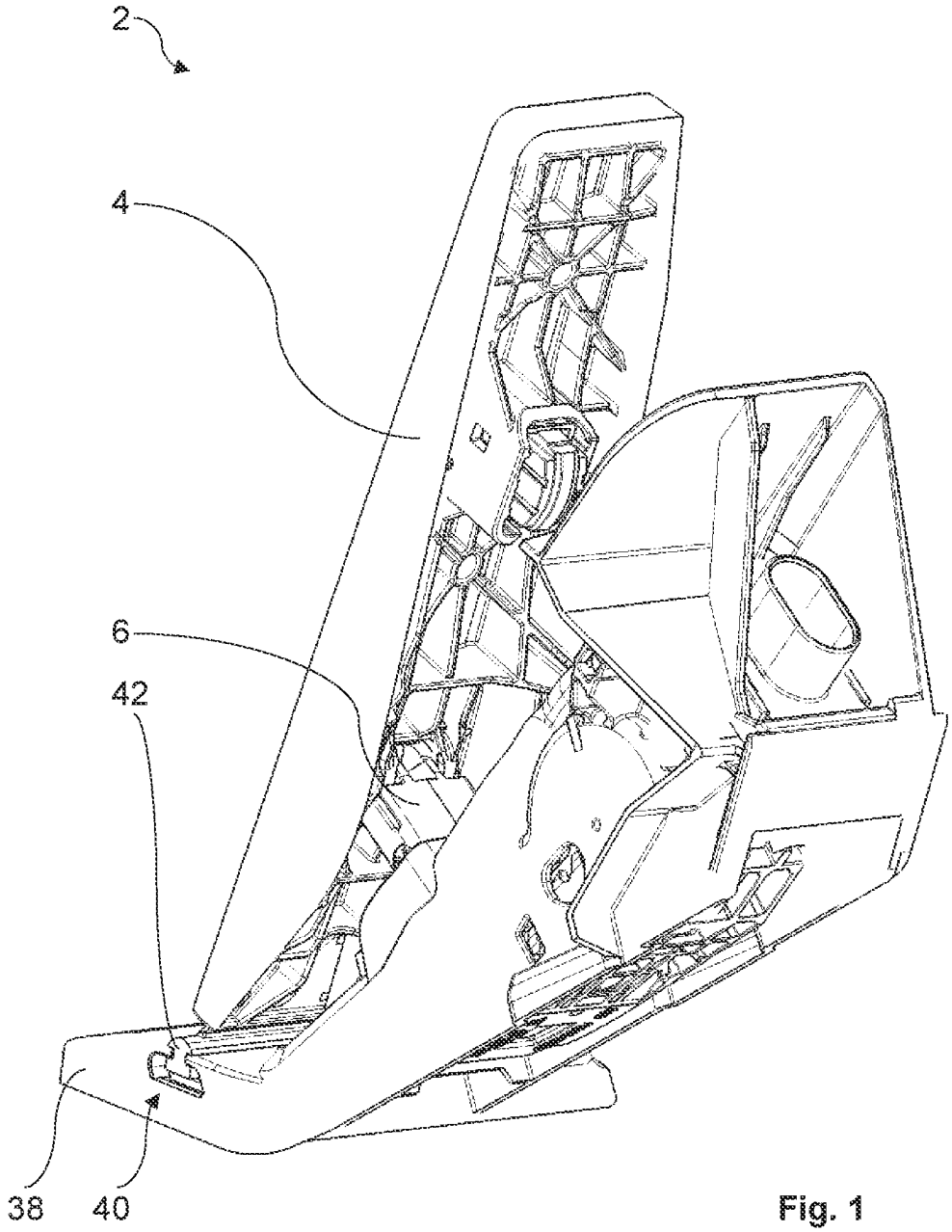
FIG. 1 is a perspective representation of a sample embodiment of the inventive vehicle pedal.

FIG. 1 shows a sample embodiment of the inventive vehicle pedal as an example. The vehicle pedal 2 takes the form of what is known as a vertical pedal and features a first part 4 in the form of a pedal lever and a second part 5 in the form of a coupling element, where the second part 5 is only shown in part in FIG. 4. In its assembled state shown in FIG. 1, the first part 4 is connected in a force-transferring and articulated manner to the second part 5 of the vehicle pedal 2 by means of a connection element 6.

Figure 3A:
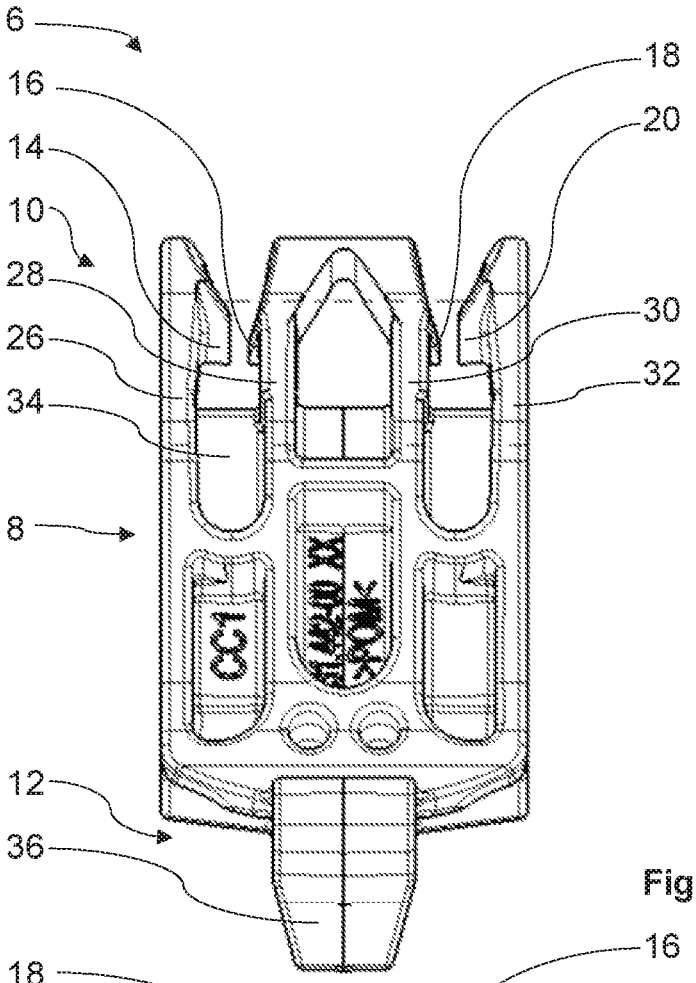
FIG. 3*a* illustrates the connection element from FIG. 2 in a frontal view.
Figure 3B:
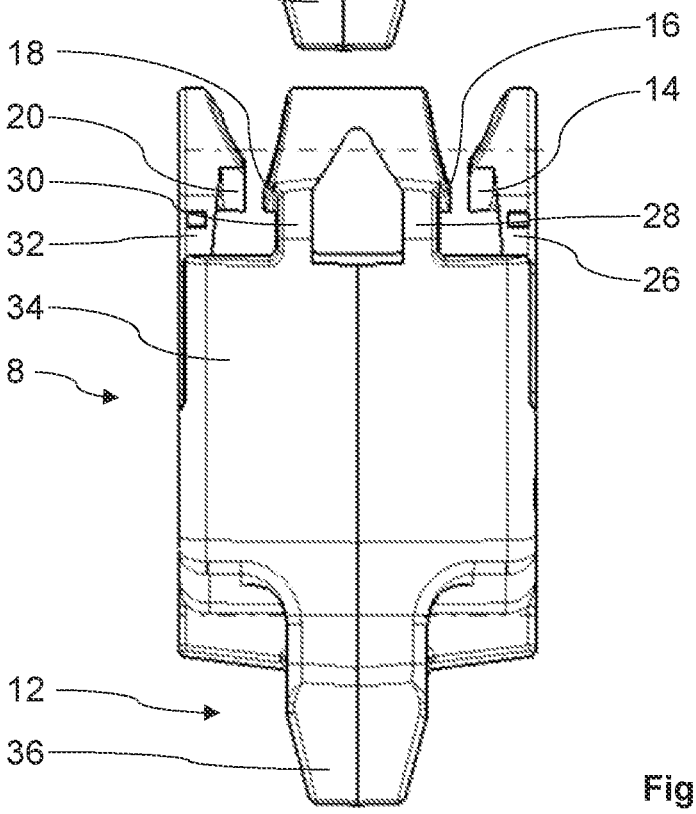
FIG. 3*b* illustrates the connection element from FIG. 2 in a rear view.
Figure 4:
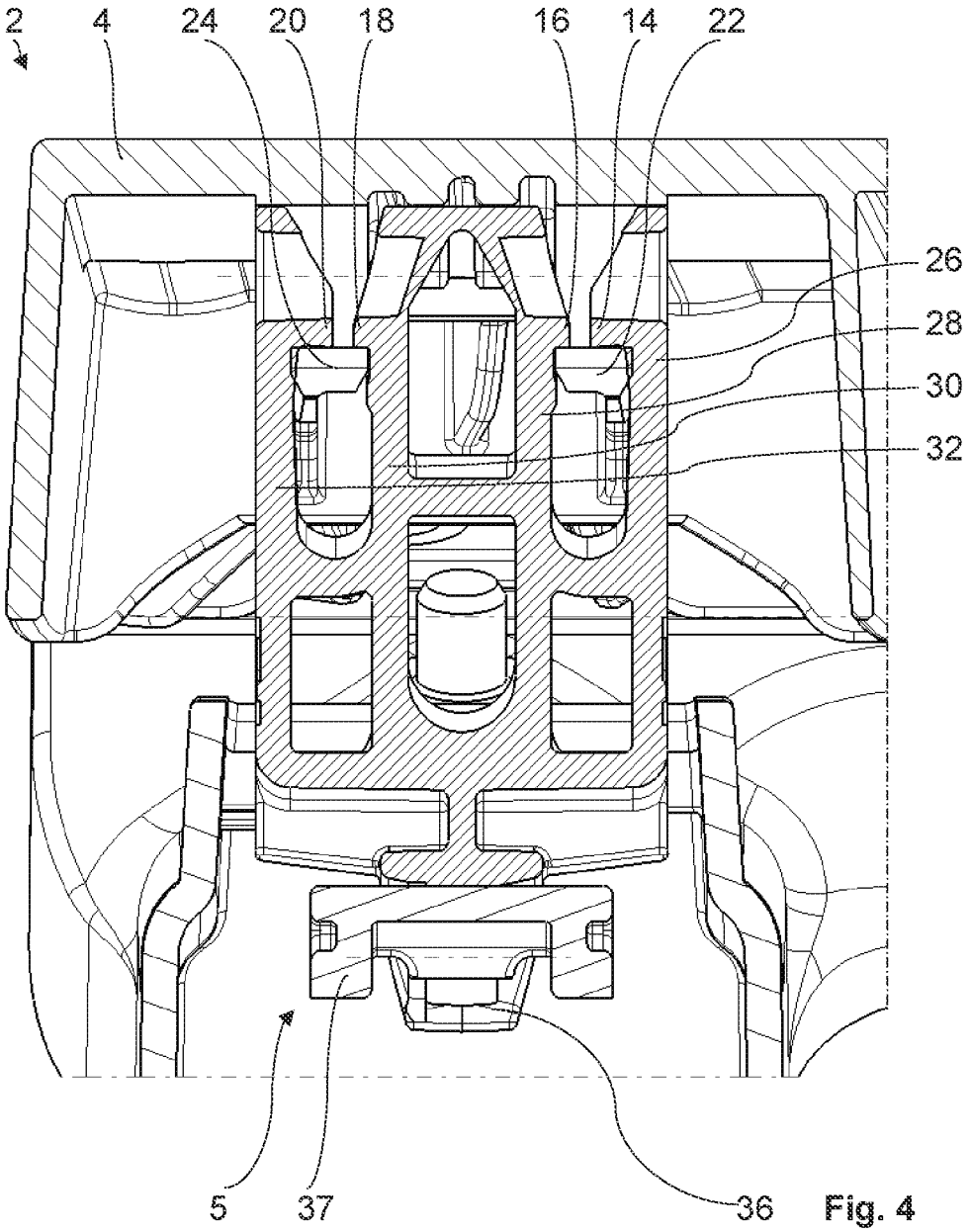
FIG. 4 illustrates the vehicle pedal from FIG. 1 in a cross-section view (partial representation).

The connection element 6 takes the form of a single-piece plastic part and comprises an essentially rigid central section 8, a first connecting section 10 for connecting the connection element 6 with the first part 4 and a second connecting section 12 for connecting the connection element 6 with the second part 5, where the two connecting sections 10, 12 are formed at free ends of the central section 8 opposite to each other. The first connecting section 10 features four first latching elements 14, 16, 18 and 20 that are formed on the central section 8 to act as a spring and, when the connection element 6 is in the assembled state shown in FIGS. 1 and 4, form a latching connection together with the latching elements 22 and 24 of the first part 4 formed corresponding to the first latching elements 14, 16, 18 and 20. The first latching elements 14, 16, 18 and 20 of the connection element 6 are shown in FIGS. 3*a*, 3*b* and 4. The corresponding latching elements 22 and 24 of the first part 4 can be seen from FIG. 4.

The total of four first latching elements 14, 16, 18 and 20 of the connection element 6 form, in the assembled state of the connection element 6 shown in FIGS. 1 and 4, a latching connection as pairs in each case, namely firstly the first latching elements 14 and 16 and secondly the first latching elements 18 and 20, with a latching element 22, 24 of the first part 4 corresponding to each pair of first latching elements 14, 16 and 18, 20, where the latching element 22 with the first latching elements 14, 16 and the latching element 24 with the first latching element 18, 20 each interacts in a latching manner. See FIG. 4.

As can be seen from FIGS. 2, 3*a*, 3*b* and 4, the first latching elements 14, 16, 18 and 20 are formed opposite each other by each pair of first latching elements 14, 16 and 18, 20 on different latching arms 26, 28, 30 and 32 of the fist connecting section 10, where the first latching element 14 is formed on the latching arm 26, the first latching element 16 on latching arm 28, the fist latching element 18 on the latching arm 30 and the first latching element 20 on the latching arm 32, namely at the free end in each case.

Each pair of first latching elements 14, 16 and 18, 20 features an exterior latching element 14 and 20 and an interior first latching element 16 and 18, where the latching arms 28 and 30 of the two interior first latching elements 16 and 18 of the two pairs 14, 16 and 18, 20 are connected to each other to transmit force in the present sample embodiment. In this context, see FIGS. 2, 3*a*, 3*b* and 4.

Furthermore, the first latching elements 14, 16, 18 and 20 take the form of a barb. In this context, see in particular FIGS. 3*a* and 3*b*. Furthermore, the first latching elements 14, 16, 18 and 20 are designed to be hollow so that during the manufacture of the connection element 6 formed as a single-piece plastic part, for example as am injection molded plastic part no unwanted material accumulation occurs in the area of the latching elements 14, 16, 18 and 20. In this context, see in particular FIGS. 2 and 4.

Figure 2:
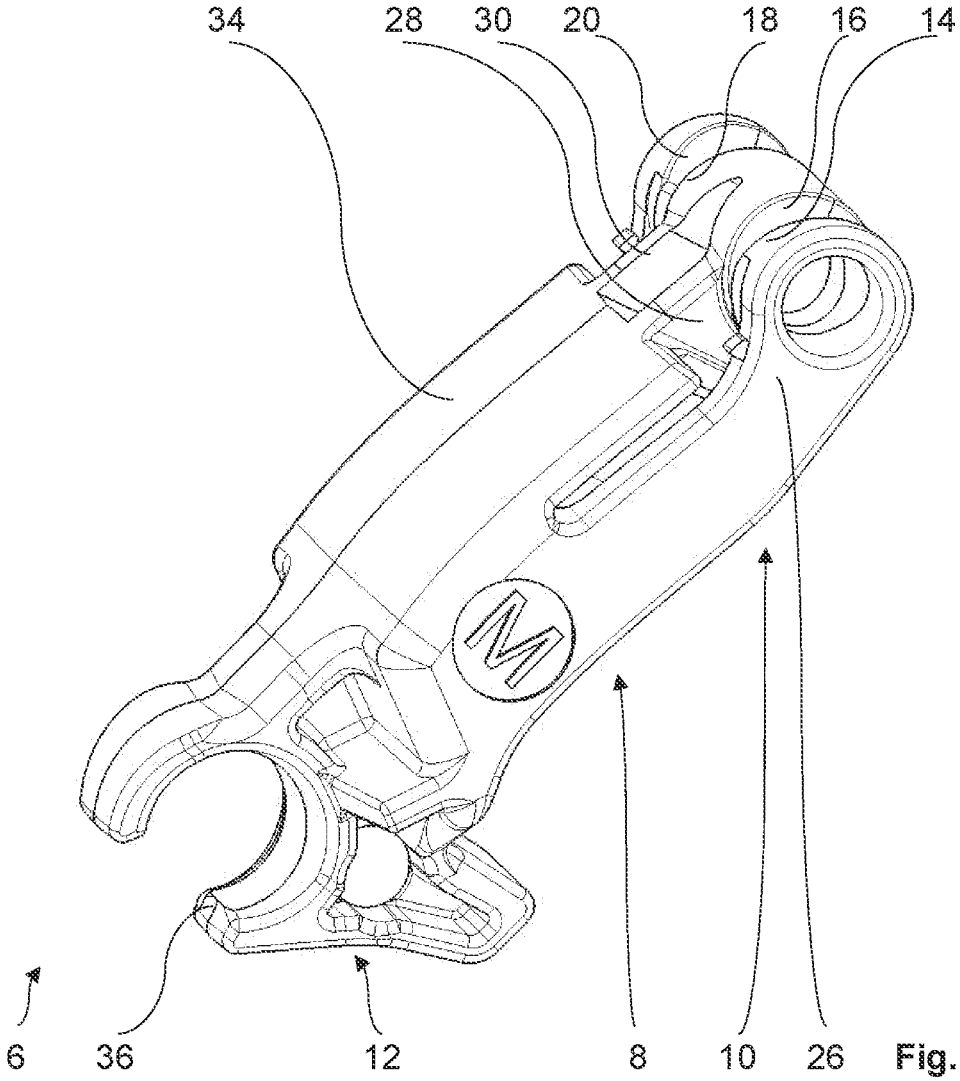
FIG. 2 is a first sample embodiment of the inventive connection element for the vehicle pedal in accordance with FIG. 1 in a perspective representation.

The latching arms 26, 28, 30 and 32 of the first connecting section 10 are, in the disassembled state of the connection element 6 shown in FIGS. 2, 3*a* and 3*b*, essentially parallel to each other. In this context, see in particular FIGS. 3*a* and 3*b*.

Furthermore, each of the latching arms 26, 28, 30 and 32 extend from a base plate 34 of the central section 8 of the connection element 6, where the force-transferring connection of the base plate 34 is formed with the individual latching arms 26, 28, 30 and 32 depending on a previously specified latching property of the latching connection. In this context, see in particular FIGS. 2 and 3*b* from which it can be seen that the base plate 34 of the central section 8 is slotted, in the area of the two exterior latching arms 26 and 32 allocated to the first latching elements 14 and 20, in such a way that the two latching arms 26 and 32 each feature longer free lengths in comparison to the two interior latching arms 28 and 30 allocated to the first latching elements 16 and 18.

Correspondingly, the exterior latching arms 26 and 32 are stiffened to a lesser degree in comparison to the two interior latching arms 28 and 30 by the base plate 34 and are thus more flexible that the interior latching arms 28 and 30, that feature only a short free length. Nevertheless, it is also conceivable that the force-transferring connection of the base plate to the individual latching arms are formed depending on a previously specified latching property of the latching connection. Depending on the requirements in each individual case, a specialist will determine the force-transferring connection of the base plate with the individual latching arms.

To achieve a latching connection with the second part 5 of the vehicle pedal 2, the connection element 6 features in its second connecting section 12 a latching bracket 36, the interior contour of which takes the form of an arc. The latching bracket 36 forms, together with a latching element 37 of the second part 5 designed to correspond to it, namely a latching bolt 37, a latching connection in the assembled state of the connection element 6. The latching bolt 37 is shown only in FIG. 4.

In the following, the functioning of the inventive vehicle pedal and the inventive connection element according to the present sample embodiments are explained on the basis of FIGS. 1, 2, 3*a*, 3*b*, 4, 5*a* and 5*b*.

The connection element 6 is initially in its disassembled state as show in FIGS. 2, 3*a* and 3*b* in which the connection element 6 is not connected in a latching manner with the first part 4 and the second part 5 of the vehicle pedal 2.

When converting the connection element 6 from its disassembled state into its assembled state shown in FIGS. 1 and 4 in which the connection element 6 is connected in a latching manner with the first part 4 and the second part 5 of the vehicle pedal 2, the connection element 6 is initially latched using the latching bracket 36 of the second connecting section 12 to the corresponding latching bolt 37 and the second part 5 and, in the image plane of FIG. 1, and inserted from bottom to top through an aperture (not shown) in a housing 38 of the vehicle pedal 2.

The first part 4 of the vehicle pedal 2 in the form of a pedal lever is connected to the housing 38 in a pivotable manner using, for example, a film hinge 42 formed on the pedal lever 4 and inserted in a groove 40 of the housing 38. The pedal lever 4, i.e. the first part 4, is swiveled around the film hinge 42 in the direction of the connection element 6 that protrudes with its first connecting section 10 from the aperture of the housing 38, such that the first latching elements 14, 16, 18 and 20 of the connection element 6 likewise form a latching connection together with the corresponding latching elements 22 and 24 of the first part 4. See also FIG. 4. Such conversion of the connection element 6 from its disassembled state into its assembled state is simplified by the fact that the first latching elements 14, 16, 18 and 20 each take the form of a barb. The first part 4 is now connected with the second part 5 of the vehicle pedal 2 such as to transmit force by means of the connection element 6.

An additional simplification for converting the inventive connection element from its disassembled state into its assembled state is, for example, made possible by the fact that corresponding lead-in chamfers are formed or arranged at the first part of the inventive vehicle pedal to the first connecting section of the connection element in order to guide in this way the first connecting section of the connection element when converting the connection element from its disassembled state into its assembled state. This makes blind mounting of the connection element possible when making the latching connection between the connection element on the one hand and the first part on the other hand.

As can be seen from FIG. 4, the two pairs of first latching elements 14, 16 and 18, 20 each encompass one of the two latching elements 22 and 24 of the first part 4, namely the two first latching elements 14, 16 encompass in the assembled state the latching element 22 and the two first latching elements 18, 20 encompass, in the assembled state, the latching element 24. Correspondingly, a secure force transmission connection is ensured between the connection element 6 on the one hand and the first part 4 on the other hand, even under adverse ambient conditions, such as with ambient temperatures in the temperature range at which the plastic from which the connection element 6 is manufactured starts to soften.

Due to the latching arms 28 and 30 connected to each other to transmit force of the two interior latching elements 16 and 18, it is possible to create a very rigid and thus very dimensionally stable latching connection between connection element 6 on the one hand and the first part 4 on the other hand. Such dimensional stability is increased in the present sample embodiment by the fact that force-transferring connections between the base plate 34 of the central section 8 and the two interior latching arms 28 and 30 extending into the range of the first latching elements 16 and 18 to such an extent that the latching arms 28 and 30 merely feature a short free length. In this context, see in particular FIG. 2.

Figure 5A:
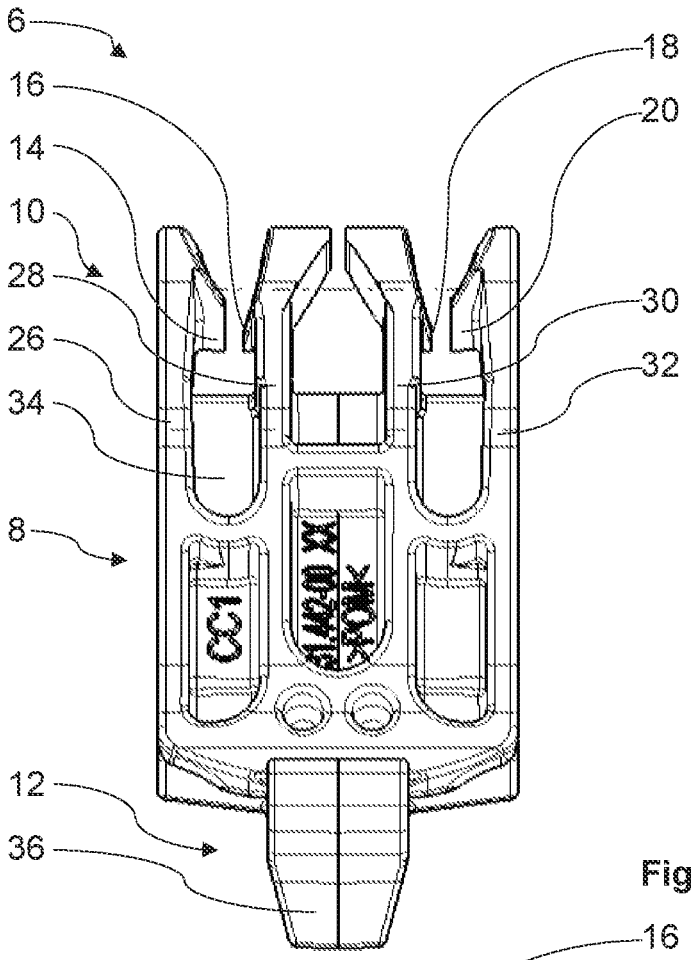
FIG. 5*a* is a second sample embodiment of the inventive connection element in a frontal view.
Figure 5B:
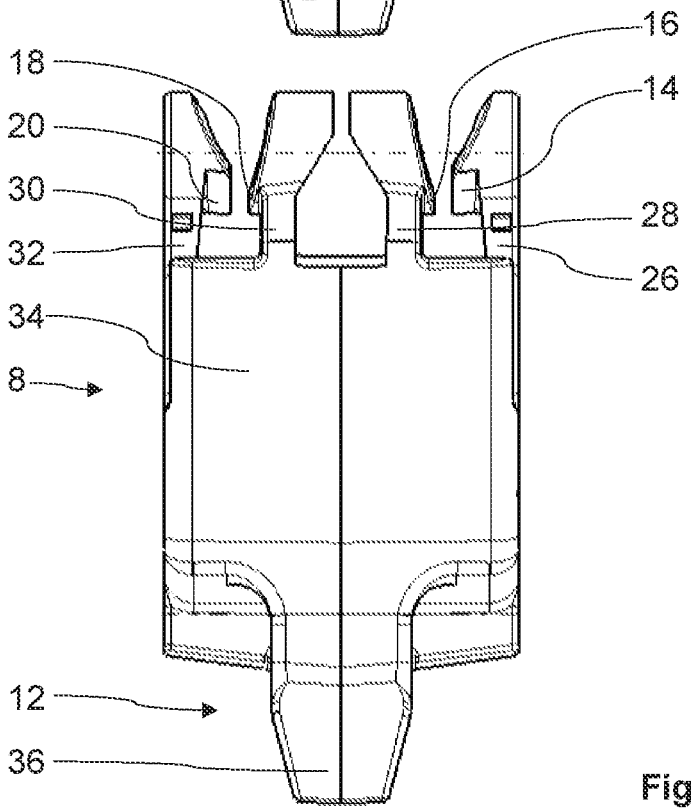
FIG. 5*b* illustrates the second sample embodiment of the inventive connection element in a rear view.

FIGS. 5*a* and 5*b* show a sample embodiment of the inventive connection element as an example. Components that are identical or have the same effect have been given the same reference numbers in the Figures. Furthermore, the second sample embodiment is explained merely to the extent of the differences to the first sample embodiment of the inventive connection element. In all other respects, reference is made to the embodiments above.

In contrast to the first sample embodiment of the inventive connection element 6 explained above, the two interior latching arms 28 and 30 with the two interior first latching elements 16 and 18 are not connected to each other to transmit force. See FIGS. 5*a* and 5*b*. Instead, the two latching arms 28 and 30 are not connected to each other in the range of the two first latching elements 16 and 18. Correspondingly, the latching arms 28 and 30 with the first latching elements 16 and 18 feature a greater degree of flexibility in comparison to the first sample embodiment of the connection element 6, such that this embodiment of the connection element 6 fulfills other demands on the latching properties of the latching connection between the connection element 6 of the second sample embodiment and the first part 4 of the vehicle pedal 2.

In all other respects, the connection element 6 of the second sample embodiment corresponds to the connection element 6 of the first sample embodiment. The same is true for the way in which it functions. Correspondingly, the connection element 6 according to the second sample embodiment can be used in a similar manner to the above explanations on the first sample embodiment regarding the vehicle pedal 2 according to the above sample embodiment.

The invention is not limited to the present sample embodiments. This means that the invention can also be deployed advantageously in other kinds of vehicle pedals. For example, use with vehicle pedals designed as what are known as hanging pedals is also conceivable.

Furthermore, it would be possible with other embodiments of the invention that the second connecting section is designed in line with the first connecting section. Correspondingly, the second connecting section could be designed identically to the first connecting section, for example according to the sample embodiments explained above. It is also conceivable that the latching connection formed by the first connecting section and the first part is designed as an articulated connection.

LIST OF REFERENCE NUMBERS

2 Vehicle pedal
4 First part of the vehicle pedal 2, designed as a pedal lever
5 Second part of the vehicle pedal 2, designed as a coupling element
6 Connection element
8 Central section of the connection element 6
10 First connecting section of the connection element 6
12 Second connecting section of the connection element 6
14 First latching element of the connection element 6
16 First latching element of the connection element 6
18 First latching element of the connection element 6
20 First latching element of the connection element 6
22 Latching element of the first part 4
24 Latching element of the first part 4
26 Latching arm of the connection element 6
28 Latching arm of the connection element 6
30 Latching arm of the connection element 6
32 Latching arm of the connection element 6
34 Base plate of the central section 8
36 Latching bracket of the connection element 6
37 Latching bolt of the second part 5
38 Housing of the vehicle pedal 2
40 Groove of the housing 38
42 Film hinge of the first part 4

The invention claimed is:

1. A connection element for connecting a first part with a second part of a vehicle pedal, the connection element comprising:
- a rigid central section,
- a first connecting section for connecting the connection element to the first part and a second connecting section for connecting the connection element with the second part,
- wherein the first and second connecting sections are formed at free ends of the central section opposite each other,
- wherein the first connecting section includes four first latching elements forming two pairs of first latching elements, where, when the connection element is in an assembled state, each pair of first latching elements form a latching connection together with a respective first latching element of the first part,
- wherein the second connecting section includes a C-shaped latching bracket configured to receive a second latching element of the second part.

2. The connection element in accordance with claim 1, wherein each of the four first latching elements are formed on a respective arm.

3. The connection element in accordance with claim 2, wherein the respective arms, in a disassembled state, are arranged parallel to each other.

4. The connection element in accordance with claim 3, wherein each pair of first latching elements includes an exterior first latching element and an interior first latching element, wherein the respective arms of the two interior first latching elements are connected with each other to transmit force.

5. The connection element in accordance with claim 2, wherein the central section includes a base plate from which the respective arms extend.

6. The connection element in accordance with claim 2, wherein each pair of first latching elements includes an exterior first latching element and an interior first latching element, wherein the respective arms of the two interior first latching elements are separated from each other such that force is not transmitted therebetween.

7. The connection element in accordance with claim 1, wherein each of the four first latching elements is a barb.

8. The connection element in accordance with claim 1, wherein the connection element takes the form of a single-piece plastic part.

9. The connection element in accordance with claim 8, wherein the four first latching elements are hollow.

10. A vehicle pedal, comprising:
- a first and second part connected to transmit force by means of a connection element,
- wherein the connection element is formed in accordance with claim 1.

11. The vehicle pedal in accordance with claim 10, wherein the connection element connects in an articulated manner the first part and the second part.

* * * * *